US006000136A

United States Patent [19]

Owens

[11] Patent Number: 6,000,136

[45] Date of Patent: Dec. 14, 1999

[54] KNIFE HANDLE

[75] Inventor: Robert L. Owens, Shaftsbury, Vt.

[73] Assignee: The Stanley Works, New Britain, Conn.

[21] Appl. No.: 09/067,282

[22] Filed: Apr. 27, 1998

[51] Int. Cl.[6] ..... B26B 1/08

[52] U.S. Cl. ..... 30/162; 30/125; 30/320; 30/335

[58] Field of Search ..... 30/162, 2, 293, 30/125, 335, 320

[56] References Cited

U.S. PATENT DOCUMENTS

| | | | |
|---|---|---|---|
| 3,092,903 | 6/1963 | Bockhold | 30/2 |
| 3,577,637 | 5/1971 | Braginetz | 30/162 |
| 4,242,795 | 1/1981 | Rollband et al | 30/162 |
| 4,586,256 | 5/1986 | Weimann | 30/162 |
| 4,920,646 | 5/1990 | Grant | 30/162 |
| 5,301,428 | 4/1994 | Wilcox | 30/162 |
| 5,509,205 | 4/1996 | Ragland, III | 30/162 |
| 5,581,890 | 12/1996 | Schmidt | 30/2 |
| 5,613,300 | 3/1997 | Schmidt | 30/2 |
| 5,890,293 | 4/1999 | Gamba | 30/162 |

*Primary Examiner*—M. Rachuba
*Assistant Examiner*—Sean Pryor
*Attorney, Agent, or Firm*—Alix, Yale & Ristas, LLP

[57] ABSTRACT

A knife handle such as in a utility knife or box cutter knife with a blade carrier having a planar blade support, parallel flanges and laterally projecting tabs for securing the blade in position on the carrier. The knife handle provides improved retention of a knife blade under torsional loads applied to the blade through the use of two or more longitudinally spaced retention tabs that capture both forward and rearward portions of the blade.

13 Claims, 2 Drawing Sheets

KNIFE HANDLE

FIELD OF THE INVENTION

This invention relates generally to the handles of knives adaptable for mounting a replaceable blade. More particularly, this invention relates to a knife handle for a utility knife employing a blade carrier for mounting a blade, in which the carrier is movable between a sheathed position wherein the blade is enclosed within the handle and one or more extended, unsheathed positions wherein the knife blade projects through an opening in the handle to present a cutting edge.

BACKGROUND OF THE INVENTION

Exemplary types of knife handles to which the present invention is particularly related are disclosed in U.S. Pat. Nos. 4,242,795 and 4,586,256. Such utility knives incorporate a blade carrier which mounts and supports a blade at the interior of the handle for longitudinal movement therein. The blade carrier incorporates a thumb-actuated button that can be depressed to unlatch the carrier from one of several latch positions for shifting the blade via the carrier to another longitudinal position. The thumb-actuated button may extend through a slot in the top of the knife handle and is secured to the blade carrier by means of a resilient finger. The knife handle is further adapted so that the blade may be relatively easily dismounted and replaced. The blades are replaced through the front opening of the knife handle or by gaining access through the side of the knife handle. Such knives have found great popularity and are of great utility in a wide variety of cutting operations.

While the foregoing knife handles are relatively inexpensive to manufacture and generally operate in an efficient and safe manner, a continuing concern is that during heavy use the blade may disengage from the carrier and either jamb in the knife handle or entirely disengage from the knife handle. More specifically, when torsional loads are applied to the exposed tip area of the blade, the blade may tend to move laterally and dislodge or disengage from the carrier. Disengagement of the knife blade is a particular problem when the knife is being used for cutting openings in plasterboard or drywall to accommodate junction boxes for electrical outlets, wall switches and telephone jacks and openings for heat registers and cold air returns. The corners for the openings may be cut using a twisting motion of the knife. Commonly, when using such knives, the blade may disengage or partially disengage from the blade carrier upon the application of only a low torsional force particularly when the knife is twisted in the clockwise direction. Therefore, the present invention is directed to further insuring that the knife blade is retained on the carrier and does not disengage from the carrier during use, especially when torsional loads are applied to the knife blade.

SUMMARY OF THE INVENTION

An object of the invention is to provide a new and improved blade carrier for a knife handle adaptable for mounting a replaceable blade.

Another object of the invention is to provide a new and improved knife handle having improved means for laterally securing the blade to the carrier.

A further object of the invention is to provide a new and improved blade carrier for a knife handle having an improved blade retention configuration which is easily and efficiently integrated into the blade carrier to further insure that the blade does not disengage from the carrier during use of the knife.

A still further object of the invention is to provide a retractable blade knife handle from which a knife blade does not readily disengage when a torsional force is applied to the knife blade.

Other objects will be in part obvious and in part pointed out more in detail hereinafter.

These and related objects are achieved by providing a knife handle comprising an elongated case which has a front blade opening and interiorly a pair of spaced guides. A blade carrier is slidably received in the guides for selective longitudinal movement along the guides between a retracted sheathed position and an extended unsheathed position so that in the unsheathed position, a blade mounted to the carrier extends through the blade opening to present a cutting edge. The blade carrier is adapted for mounting a blade and includes a planar blade support, a generally laterally projecting flange for retaining the blade in position and two or more tabs adapted to capture a mounted blade for lateral retention of the blade in cooperation with the blade support.

The blade for use with the invention is of the conventional type which is of a generally planar, trapezoidal shape. The blade has planar side surfaces, opposed upper and lower edges and opposed cutting tips. The blade typically features one or more locating notches formed in its upper edge arranged on or about the vertical center line of the blade. When a plurality of notches, and in particular two notches, are formed in the upper edge of the blade, the blade may be conveniently reversed end for end to selectively expose one or the other cutting tips of the blade.

It will be appreciated that the blade may vary somewhat in shape owing to the specific cutting task to be performed by the blade. for example, the blade may be formed with a hooked cutting edge, or other specialized cutting edge. However, the features of the blade, particularly as they relate to the invention, will remain generally unchanged.

The blade carrier preferably includes a lug which is adapted for engagement with a notch formed in the upper edge of a mounted blade to secure the blade to the carrier. The carrier also includes a plurality of tabs for lateral retention of the blade on the carrier. Each of the tabs include a bearing edge which is laterally spaced from the planar blade support for capturing a mounted blade between the planar support and the bearing edge. The tabs extend from an upper portion of the carrier toward the lug. In a preferred form, a first tab extends generally forwardly and downwardly from the carrier adjacent a resilient finger which extends rearwardly and is adapted for manual actuation to selectively secure and locate the carrier in a plurality of longitudinal positions within the case. A second tab located forward of the lug extends generally rearwardly and downwardly from an upper portion of the blade carrier.

The invention accordingly comprises the several components and the relation of such components with respect to each of the others and the article possessing the features, properties, and relation of elements exemplified in the following detailed disclosure.

DETAILED DESCRIPTION OF THE INVENTION

Figure 1:
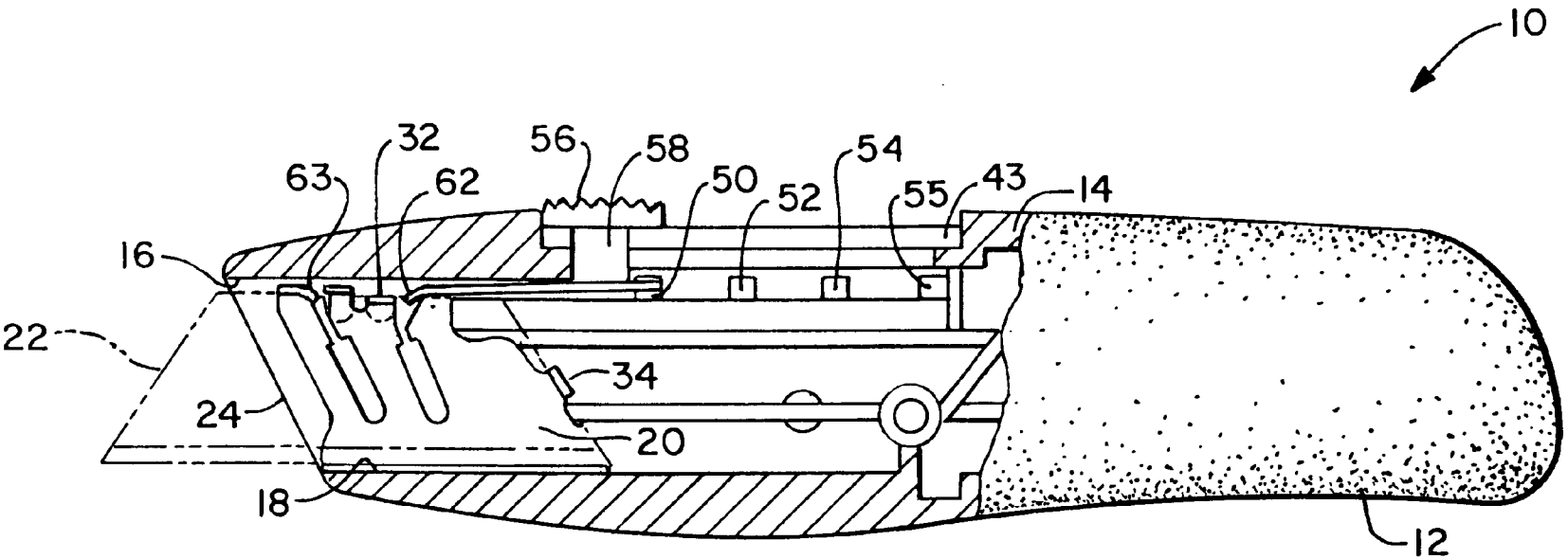
FIG. 1 is a side-elevational view of a retractable blade knife handle of the present invention, partly broken away and partly in section, a mounted blade being illustrated by broken lines.

With reference to the drawing wherein like numerals represent like parts throughout the several Figures, a retractable blade knife handle in accordance with the present invention is generally designated by the numeral 10. Knife handle 10 comprises a pair of mating case sections 12 and 14 which are assembled to form a hollow interior and an exterior which is contoured to facilitate grasping of the handle. Case section 14 interiorly forms equidistantly spaced guideways 16 and 18 for slidably mounting a generally planar blade carrier 20 for linear longitudinal movement interior of the case sections.

A removably replaceable blade 22 is mounted in fixed position to the blade carrier 20. The case sections cooperate to form a forward blade opening 24 so that the blade 22 may be longitudinally moved by the blade carrier to an extended unsheathed position wherein the cutting edge of the blade extends through the opening 24 to present a cutting edge as illustrated in FIG. 1. The blade carrier may be retracted to a sheathed position (not illustrated) by shifting the blade carrier (to the right of FIG. 1) so that the blade 22 is entirely enclosed by the case sections. The illustrated embodiment is a side-loading knife handle in that the mounted blade may be replaced by removing or pivotally opening the case sections to obtain access to the carrier. In this latter regard, knife handle 10 may be similar in form and function to that described in U.S. Pat. No. 4,586,256 which is incorporated herein by reference. The invention is equally applicable to a utility knife handle such as disclosed in U.S. Pat. No. 3,577,637 wherein the blade may be dismounted or mounted through the front opening of the case when the carrier is longitudinally moved to a forward longitudinal position and a retention lug is released.

Blade carrier 20 includes a generally upright planar blade support 26. A flange 28 extends generally perpendicularly from the top of the blade support 26 toward the opposite case section 12. A second flange 30 parallel to flange 28 extends generally perpendicularly from the bottom of the blade support toward the opposite case section 12. Blade 22 engages against planar support 26 and is retained between flanges 28 and 30 of the blade carrier for generally upright vertical or transverse retention. Blade 22, which has one or more upper locating notches 23 and a lower cutting edge, is retained in a fixed longitudinal position to the blade carrier by a lug 32. Lug 32 generally laterally projects from the blade carrier at a position slightly below flange 28. Lug 32 engages one of the notches 23 at the top of the blade. The blade may also be retained in a fixed longitudinal position by a rearward retention tab 34 which extends obliquely relative to flanges 28 and 30 for engaging a rear non-cutting edge of the blade.

Flanges 28 and 30 are additionally adapted for reception on guideways 16 and 18, respectively, for sliding movement therealong interiorly of the case sections. A pair of spaced longitudinally extending channels are defined by a pair of spaced longitudinally extending retention ribs (not shown) which extend from the interior side of case section 12. The retention ribs cooperate with the blade support to aid in the lateral retention of the intermediately positioned blade 22.

A platform 45 generally aligns with flange 28 and extends generally perpendicularly toward case section 12 from an upper rear portion of planar blade support 26. An integral resilient finger 46 extends rearwardly from platform 45. A pair of oppositely projecting latching tabs 48 at the rear terminus of finger 46 are biased by the resilience of the finger 46 to be received in any one of notches 50, 52, 54 and 55 to latch the blade carrier and hence to securely position a mounted blade in a selected unsheathed or sheathed longitudinal position. The foregoing notches are formed in the top interior of the case sections 12 and 14. In the knife handle illustrated in the drawing, reception of tabs 48 in notches 50, 52 and 54 define three unsheathed or cutting positions of blade 22. A thumb button 56 is connected to the resilient finger 46 by a neck 58 which extends upwardly through a longitudinal slot 43 formed in the top of the knife handle. The blade carrier 20 may be manually longitudinally shifted by pressing the thumb button 56 to unlatch the latching tab 48 and moving the blade carrier longitudinally with respect to the case sections.

A first integral lateral retention tab 62 extends from a forward portion of the laterally projecting platform 45 which connects resilient finger 46 to the upper rear portion of carrier 20. The lateral retention tab 62 extends forwardly and downwardly at an acute angle to the platform. Lateral retention tab 62 forms a bearing edge 64 which is generally parallel to the planar blade support 26 and equidistantly spaced therefrom. A second integral lateral retention tab 63 extends from a rearward portion of the flange 28 of carrier 20. The second retention tab extends rearwardly and downwardly at an acute angle to the platform and similarly forms a bearing edge 65. The distance between the bearing edges 64, 65 and the planar blade support 26 is roughly commensurate with the thickness of a blade adapted for mounting to the carrier and is in preferred embodiments on the order of 0.015 inches, 0.025 inches, or 0.035 inches. Other blade thicknesses and corresponding distances may also be employed.

It will be appreciated that when the blade 22 is mounted or seated in the carrier, a segment of the upper portion of the blade is captured between the bearing edges 64, 65 of the lateral retention tabs 62, 63, respectively, and the planar blade support and thereby provides for increased lateral retention of the blade on the carrier. While the lateral retention tabs 62, 63 extend downwardly from the upper portion of the carrier to capture the blade, the downward extension of tabs 62, 63 is limited to allow the tabs to be accommodated in the previously described (but not shown) longitudinally extending channel so that the tabs do not impede the efficient longitudinal shifting of the carrier.

Tab 62 is located a predetermined distance rearwardly of lug 32. Tab 63 is located a predetermined distance forwardly of lug 32. In FIG. 1, tab 62 is shown to be located rearwardly of lug 32 a distance shorter than the distance tab 63 is located forwardly of lug 32. Thus in the embodiment illustrated in FIGS. 1–3, the tabs are located asymmetrically relative to the lug.

The lowermost portions of tabs 62, 63 are roughly level with lug 32. In addition, the retention tabs do not detract from the efficient blade replacement characteristics of the knife handle. During heavy duty cutting operations when the blade is extended, the longitudinal push-pull cutting forces are partially distributed to the lug 32, and lug 32 becomes a focal point for forces exerted against the blade. By locating the lateral retention tabs 62 and 63 spaced apart but generally in close proximity to lug 32, the magnitude of the heavy duty cutting forces exerted against the lug which would be sufficient to laterally disengage or dislodge the blade from the carrier seat is greatly increased, and hence the likelihood that the blade will disengage the carrier is substantially lessened. Furthermore, when clockwise torsional force is applied to the blade, such as when cutting curved pieces, corners, or when twisting the blade to enlarge an opening, the retention tabs dramatically improve the retention of the blade on the carrier. In accordance with the invention, retention tabs 62 and 63 may extend a greater length than that illustrated in the drawings. The retention tabs may also extend forwardly and downwardly at various angles to the platform.

Figure 2:
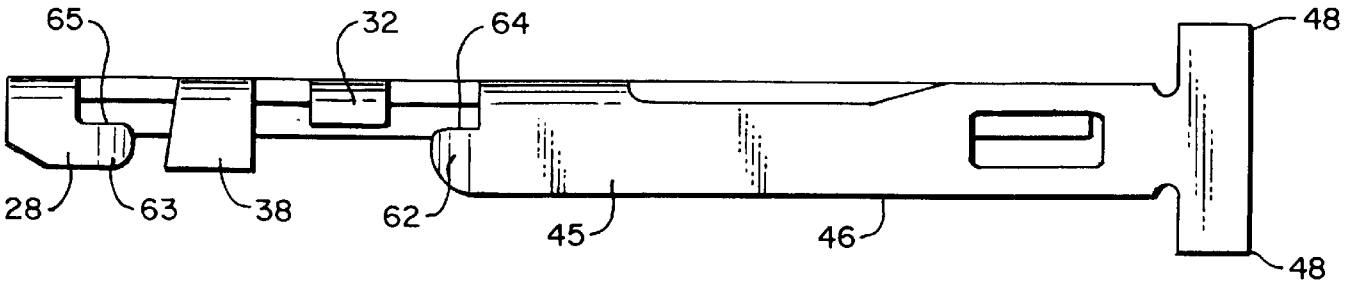
FIG. 2 is a top plan view of a blade carrier of the invention.
Figure 3:
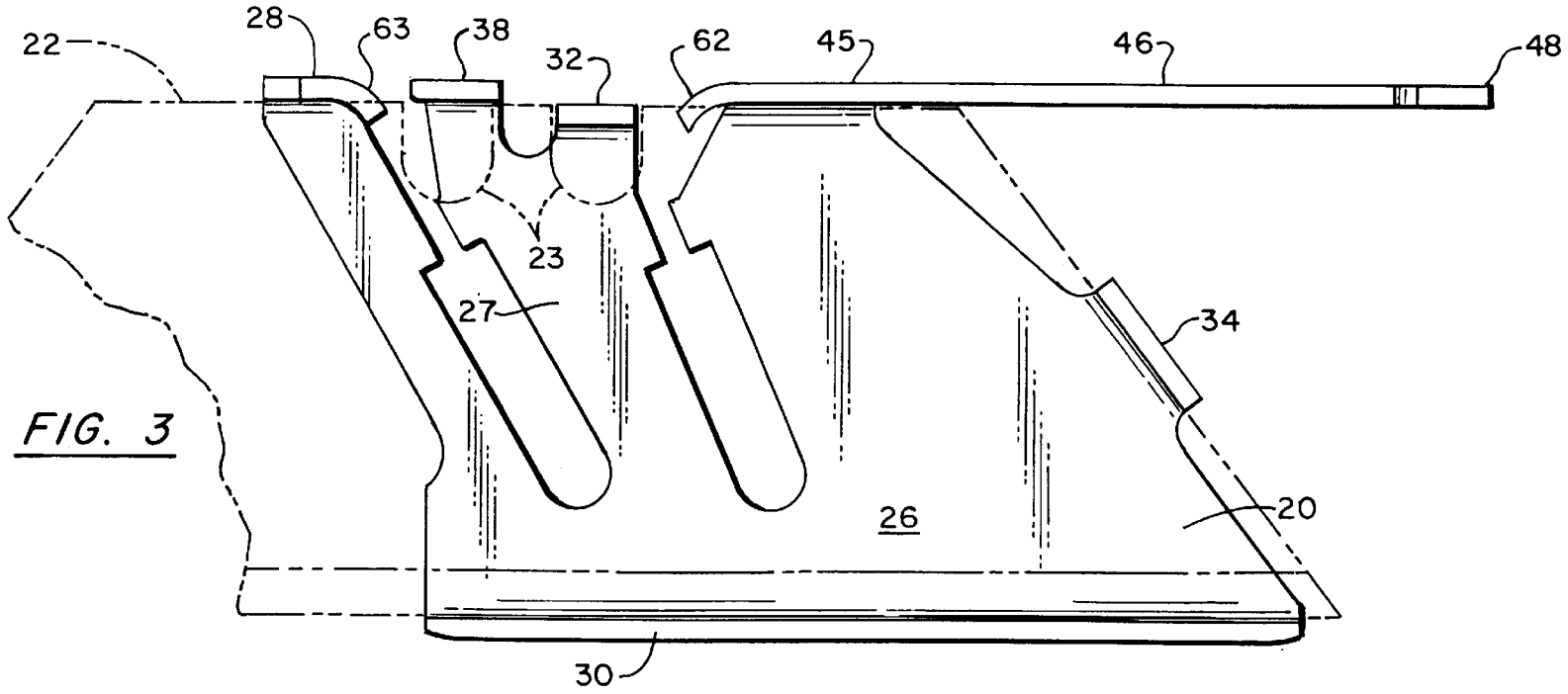
FIG. 3 is a side-elevational view of a blade carrier of the invention.

With reference to FIGS. 2 and 3, a blade carrier of the invention is shown in enlarged plan view and in side elevation. The planar section 26 of the blade carrier has a resilient intermediate separated planar section which upwardly terminates in a laterally extending lug 32 and an adjacent finger tab 38 for mounting a thumb button. When the carrier 20 is moved to an extended position, manual lateral movement of the finger tab 38 forces the lug 32 to disengage from the notch of the blade to allow for replacement of the blade through the front opening of the knife handle. Although blade replacement in this embodiment is performed from a generally frontal orientation relative to the blade carrier 20 it is within the scope of this invention to have a knife handle wherein the blades are replaceable in a generally lateral orientation. It will be appreciated that the lateral retention tabs 62, 63 and their respective bearing surfaces 64, 65 do not materially interfere with the blade replacement process when the blade is replaced in either a forward orientation or a lateral orientation.

Practitioners of the art will recognize the blade carrier and its associated features can be integrally formed from sheet metal, by cutting and bending the sheet to the desired shape with all the flanges, lugs, fingers and tabs formed from a single sheet of metal. Alternatively, the carrier may also be formed using a metal die casting technique or even by molding the carrier from a reinforced plastic.

The relative performance of various blade carriers of knives was examined through comparative testing. In this series of tests the ability of blade carriers to retain blades under torsional force conditions simulating actual use conditions was examined. In particular, the test was modeled to simulate work conditions where the knife blade is used to cut openings in plasterboard and twisted to cut curves and corners in the plasterboard. In the test, the knife blade is held in a stationary vice and the knife handle is twisted in a clockwise direction to exert an initial 6 lb.-in. of torsional load. The blades and knife handles were examined after application of the initial torsional load to determine whether the blade remained fully engaged with the handle, or whether the blade had either partially or fully released from the handle. The torsional load was then increased in 3 lb.-in. increments and examined after every increase until failure (i.e.,full release of the blade) occurred.

Knife handles with three different types of knife carriers were tested according to this method. The first twelve knife handles (C-1 through C-6 and C-7 through C-12) were for comparative testing. The Comparative Example C-1 through C-6 knives had blade carriers which featured a single lateral retention tab located forward of the lug. The Comparative Example C-7 through C-12 knives featured blade carriers with a single lateral retention tab located rearward of the lug as disclosed in U.S. Pat. No. 4,586,256. Examples X-1 through X-6 feature blade carriers of the present invention having two lateral retention tabs, the first tab located forward of the lug and a second tab located rearward of the lug. The results of the testing of the comparative examples and the examples of the invention are presented below in the Table.

PERFORMANCE OF KNIVES ON APPLICATION OF CLOCKWISE TORSIONAL LOAD

| Load Applied | COMPARATIVE EXAMPLES | | | | | | | | | | | | | | | | | |
|---|---|---|---|---|---|---|---|---|---|---|---|---|---|---|---|---|---|---|
| in | FORWARD TAB | | | | | | REARWARD TAB | | | | | | EXAMPLES OF THE INVENTION | | | | | |
| lb.-in. | C-1 | C-2 | C-3 | C-4 | C-5 | C-6 | C-7 | C-8 | C-9 | C-10 | C-11 | C-12 | X-1 | X-2 | X-3 | X-4 | X-5 | X-6 |
| 6 | — | — | PR | — | PR | — | — | — | — | — | — | — | — | — | — | — | — | — |
| 9 | PR | PR | PR | PR | PR | PR | — | R | — | — | — | — | — | — | — | — | — | — |
| 12 | PR | R | PR | PR | PR | PR | R | | R | R | R | — | — | — | — | — | — | — |
| 15 | R | | R | R | R | PR | | | | | | R | — | — | — | — | — | — |
| 18 | | | | | | R | | | | | | | — | — | — | — | — | — |
| 21 | | | | | | | | | | | | | — | — | — | — | — | — |
| 24 | | | | | | | | | | | | | — | — | — | — | — | — |
| 27 | | | | | | | | | | | | | — | — | — | — | — | — |
| 30 | | | | | | | | | | | | | — | — | — | — | — | — |
| 33 | | | | | | | | | | | | | — | — | — | — | R | — |
| 36 | | | | | | | | | | | | | R | — | R | — | | — |
| 39 | | | | | | | | | | | | | | R | | R | | R |

PR = Partial release of blade
R = Full release of blade
— = No change noted

In the Table it can clearly be seen that a blade carrier having a single lateral retention tab located forward of the lug (Comparative Examples C-1 through C-6) did not provide for retention of the blade even under application of very low torsional forces applied in the clockwise direction. In two of six Comparative Examples, partial release of the blade occurred upon the application of the initial 6 lb.-in. torsional load. On average for the C-1 through C-6 Comparative Examples, partial release of the blade occurred at 8 lb.-in. Torque. Complete release of the blade occurred at an average load of 15 lb.-in. torque.

In the testing of the C-7 through C-12 Comparative Examples with carriers having a lateral retention tab located rearward of the lug, on application of a clockwise torsion load no partial release of the blade occurred. However, full release of the blade on average occurred at the application of only 12 lb.-in. torque. Surprisingly, this is lower than the results obtained for knives with blade carriers possessing a single lateral retention tab forward of the lug.

The results shown in the Table for knives of the present invention (Examples X-1 through X-6) demonstrate a dramatic improvement in blade retention over the Comparative Examples. Examples X-1 through X-6 exhibited an average load at release of 37 lb.-in. This torsional load is over 460% of the load at release of comparative example knives C-1 through C-6, and over 305% of the load at release of comparative examples C-7 through C-12.

Therefore, in view of the findings of the comparative tests presented in the Table, the knife handle of the present invention offers a significant and even dramatic improvement over knife handles known in the art.

A preferred embodiment of the invention has been set forth for purposes of illustration and the foregoing description should not be deemed a limitation of the invention herein. Accordingly, various modifications, adaptations, and alternatives may occur to one skilled in the art without departing from the spirit arid scope of the present invention. While the invention has been described in reference to retractable blade knives, the features of the invention can easily be incorporated in knives having fixed (non-retractable) blades. Fixed blade knives are therefore within the scope of this invention.

I claim:

1. A utility knife handle for a detachable blade of the type having planar side surfaces, opposed peripheral edges and a cutting tip comprising:

an elongated handle casing having a forward opening through which a blade can extend to expose the cutting tip, and a blade carrier mount ed within the handle casing adjacent the opening for mounting a knife blade thereon in a fixed position relative to the carrier so that the blade may extend through the opening to expose the cutting tip, said blade carrier comprising a generally planar blade support portion, retainer means projecting laterally from the blade support portion to removably support the blade so that one side surface of the blade faces said blade support portion while the retaining means engages at least one of said opposed peripheral edges of the blade to limit movement of the blade relative to the carrier; and at least a pair of longitudinally spaced tabs confronting the side surface of the blade opposite said one side to limit lateral movement of the blade.

2. The knife of claim 1, wherein each of said tabs have a bearing edge spaced from the planar blade support portion by a distance slightly greater than the thickness of the blade positioned therebetween.

3. The knife of claim 2, wherein the bearing edge of each tab is spaced from the planar blade supporting portion an approximately equal distance.

4. The knife of claim 1, wherein the blade carrier is slideably mounted within the handle for selective longitudinal movement between a retracted, sheathed position within the knife handle and an extended unsheathed position wherein a blade mounted to the blade carrier presents a cutting tip outside the knife handle.

5. The knife of claim 1, wherein the retainer means includes a lug for engagement with a notch at the top of a mounted blade for restraining movement of the blade longitudinally relative to the carrier.

6. The knife of claim 5, wherein the longitudinally spaced tabs include a first tab disposed adjacent and forward of the lug and second tab disposed adjacent an d rearward of the lug.

7. The knife as claimed in claim 1, wherein the blade carrier is fixedly mounted within the handle whereby a blade mounted to the carrier presents a cutting tip outside the knife handle.

8. A blade carrier for a utility knife handle suited for supporting a detachable blade of the type having planar side surfaces and opposed peripheral edges, said blade carrier comprising:

a generally planar blade support portion, retainer means projecting laterally from the blade support portion to removably support the blade in a fixed position relative to the carrier so that one side surface of the blade confronts said blade support portion while the retaining means overlies at least one of said opposed peripheral edges of the blade; and at least a pair of longitudinally spaced tabs confronting the side surface of the blade opposite said one side to limit lateral movement of the blade when mounted on the carrier.

9. The blade carrier of claim 8, wherein each of said tabs have a bearing edge spaced from the planar blade support portion by a distance slightly greater than the thickness of the blade positioned therebetween.

10. The blade carrier of claim 9, wherein the bearing edge of each tab is spaced from the planar blade supporting portion an approximately equal distance.

11. The blade carrier of claim 8, wherein the retainer means includes a lug for engagement with a notch at the top of a mounted blade for restraining movement of the blade longitudinally relative to the carrier.

12. The blade carrier of claim 11, wherein said lug is positioned intermediate the longitudinally spaced tabs.

13. The blade carrier of claim 8, including position control means for selective longitudinal positioning of the carrier within the knife handle at a retracted, sheathed position and an extended unsheathed position.

* * * * *